United States Patent [19]

Guénard et al.

[11] 3,962,604

[45] June 8, 1976

[54] DEFLECTION SYSTEM FOR A CATHODE RAY TUBE

[75] Inventors: Roger Guénard, Aulnay-sous-Bois; Jean-Claude Bonno, Bruyeres-le-Chatel, both of France

[73] Assignee: Compagnie Industrielle des Telecommunications Cit-Alcatel, France

[22] Filed: June 12, 1974

[21] Appl. No.: 478,734

[30] Foreign Application Priority Data

June 13, 1973 France ..... 73.21484

[52] U.S. Cl. ..... 315/391; 315/365; 315/389; 340/324 A

[51] Int. Cl.[2] ..... H01J 29/70

[58] Field of Search ..... 315/365, 389, 391; 340/324 A; 235/198

[56] References Cited

UNITED STATES PATENTS 3,449,620 6/1969 Caron et al. ..... 315/391 X 3,757,162 9/1973 Johnson ..... 315/391 X

*Primary Examiner*—Richard A. Farley
*Assistant Examiner*—Richard E. Berger
*Attorney, Agent, or Firm*—Craig & Antonelli

[57] ABSTRACT

Deflection system for a cathode ray tube used in synthetic generators of curves comprising a vertical deflection device and a horizontal deflection device. Each of the devices comprises a main loop with a main deflection coil producing a deflection having a high amplitude with a slow variation and a secondary loop with a secondary coil producing a deflection having a low amplitude with a rapid variation; the main loop is fed by a deflection signal and produces an error signal feeding the secondary loop. Compensation for the delay and for the faults inserted by the main loop and use of only one deflection signal for each device is provided.

7 Claims, 12 Drawing Figures

DEFLECTION SYSTEM FOR A CATHODE RAY TUBE

The present invention relates to a deflection system for a cathode ray tube comprising a horizontal deflection device and a vertical deflection device.

Deflection devices for a cathode ray tube comprising a horizontal deflection device and a vertical deflection device in which each of the deflection devices is constituted by a rapid response deflection circuit and by a slow response deflection circuit are known.

These deflection systems are used for example in visual display devices in which synthetic images (for example tracing tables) are generated. Such prior deflection systems include a slow response deflection circuit and a fast response deflection circuit.

The slow response deflection circuit comprises, in series, a subtractor having a + input and a − input, a direct current amplifier having a limited band, a deflection coil and a measuring resistor connected to ground, the common point between the resistor and the deflection winding being connected to the − input of the subtractor.

The subtractor receives, on its + input, a deflection signal.

The rapid response deflection circuit comprises a subtractor having a + input and a − input and an output connected to the input of a wide band direct current amplifier feeding deflection means and negative feed back means whose output is connected to the − input of the subtractor.

This deflection system is generally used with a device sending out simultaneously a first series and a second series of discreet values representing the abscissae and the ordinates of a sequence of points which are to be made to appear on the screen of the cathode tube. The curves to be represented are defined by means of a sequence of points sufficiently close together.

To make these points appear, signals in the form of the steps of a staircase, obtained from the two series of values of the abscissae and of the ordinates, are applied to the horizontal and vertical deflection devices.

The curves and figures to be traced may be situated in regions of the screen of the tube spaced apart from one another; and it is therefore necessary, in order to make the spot pass from one region of the tube to another, to apply to each of the deflection devices, signals which may have a great amplitude. In conventional systems, to obtain a rapid response to signals having a slight amplitude, the deflection signals applied to each deflection device is separated into two signals: a signal having great amplitude which is applied to the slow response circuit and a signal having slight amplitude which is applied to the rapid response deflection circuit.

To use conventional deflection systems, it is therefore necessary to generate, for each of the deflection devices, two deflection signals, this requiring the use of extra elements.

Moreover, when a signal is applied to the slow response deflection circuit of one of the deflection devices, there will be a delay which is not compensated and which causes a deformation of the curves traced.

The deflection system for a cathode ray tube according to the invention making it possible to avoid these drawbacks comprises a horizontal deflection device and a vertical deflection device, each of these deflection devices comprising a slow response deflection circuit and a rapid response deflection circuit, the slow response deflection circuit comprising, in series, a subtractor having a + input and a − input, a direct current amplifier having a limited band, a deflection coil and a measuring resistor connected to ground, the common point between the resistor and the coil being connected to the − input of the subtractor and the said subtractor receiving, at its + input, a deflection signal, and the rapid response deflection circuit comprising a subtractor having a + input, a − input and an output connected to the input of a wide band direct current amplifier feeding deflection means and negative feed back means whose output is connected to the − input of the subtractor and is characterized in that, in each of the deflection devices, the + input of the subtractor of the rapid response deflection circuit is connected to the output of the subtractor of the slow response deflection circuit.

In the deflection system according to the invention, a single deflection signal is used for each deflection device, the signal being applied to the input of the subtractor of the slow response deflection circuit of the deflection device in question.

Moreover, the signal corresponding to the delay between the signal applied to the subtractor and the signal sent in the deflection coil of the slow response deflection circuit is measured at the output of the subtractor of the slow response deflection circuit then applied to an input of the subtractor of the rapid response deflection circuit which will correct that delay.

According to a first particular embodiment of the invention, the deflection means of the rapid response deflection circuit are constituted by a coil one of whose ends is connected to the output of the direct current amplifier and whose other end is connected to the negative feed back means, the said negative feed back means being constituted by a grounded resistor whose common point with the deflection coil is connected to the − input of the subtractor.

According to a second particular embodiment of the invention, the direct current amplifier of the rapid response deflection circuit comprises two symmetrical outputs connected to the deflection means of that circuit constituted by the plates and in that the negative feed back means of the said circuit are constituted by a secondary subtractor whose inputs are connected to the outputs of the direct-current amplifier and whose output is connected to the − input of the main subtractor feeding the direct current amplifier.

According to an improvement of the invention, the deflection system comprises: two threshold devices each connected to the output of the subtractor of each slow response deflection circuit and providing a signal when they are fed by signals which have a lower value than a rapid response circuit saturation signal So; an AND circuit fed by the two threshold devices and whose output signal is used for controlling the applying of the rapid signals to the deflection devices.

The following description with reference to the accompanying figures will make it easier to understand how the invention may be implemented:

Figure 6:
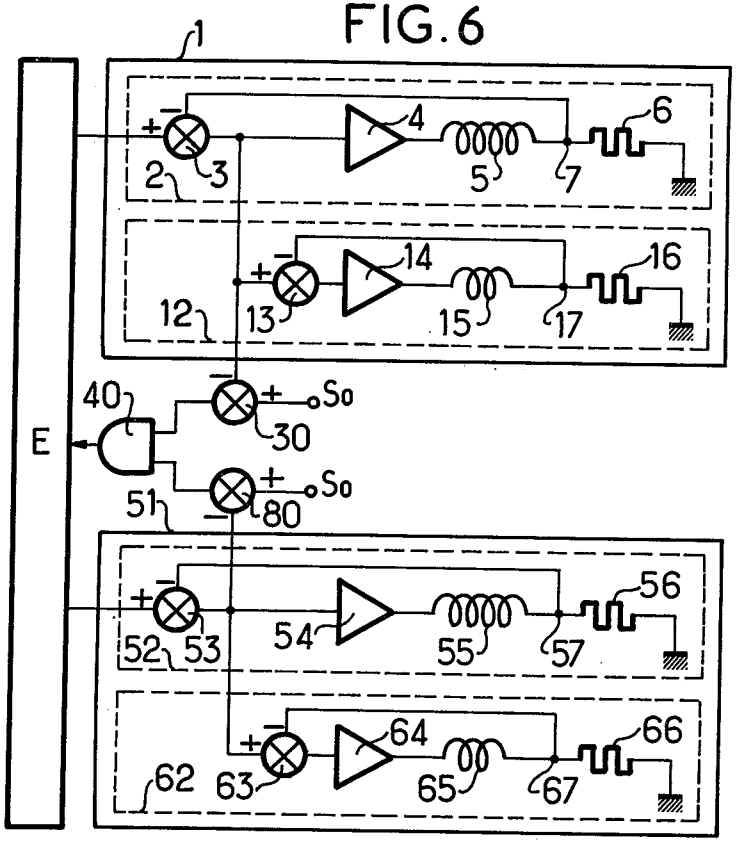

FIGS. 4*a*, 4*b*, 4*c*, 4*d* show signal variation curves as a function of time in the deflection system of a known type;

FIGS. 5*a*, 5*b*, 5*c*, 5*d* show signal variation curves in the deflection system according to the invention;

FIG. 6 shows an improvement to the deflection system according to the invention.

system according to the invention, the + input of the subtractor 13 is connected to the output of the subtractor 3 and the + input of the subtractor 63 is connected to the output of the subtractor 53.

According to an example of embodiment of the deflection system the elements have the following values;

| | | |
|---|---|---|
| Coils 5 and 55 | Self-induction | L = 550 microHenrys |
| | Internal resistance | Ri = 1.1 ohm |
| Resistances 6 and 56 | | R = 0.47 ohm |
| Band width at 3 dB for the slow response deflection circuits: | | |
| | B = 33 kc/s | |
| Coils 15 and 65 | Self-induction | L = 1.2 microHenry |
| | Internal resistance | Ri = 0.05 ohm |
| Resistances 16 and 66 | | R = 0.22 ohm |
| Band width at 3 dB for the rapid response deflection circuits: | | |
| | B = 8.5 Mc/s | |

Figure 1:
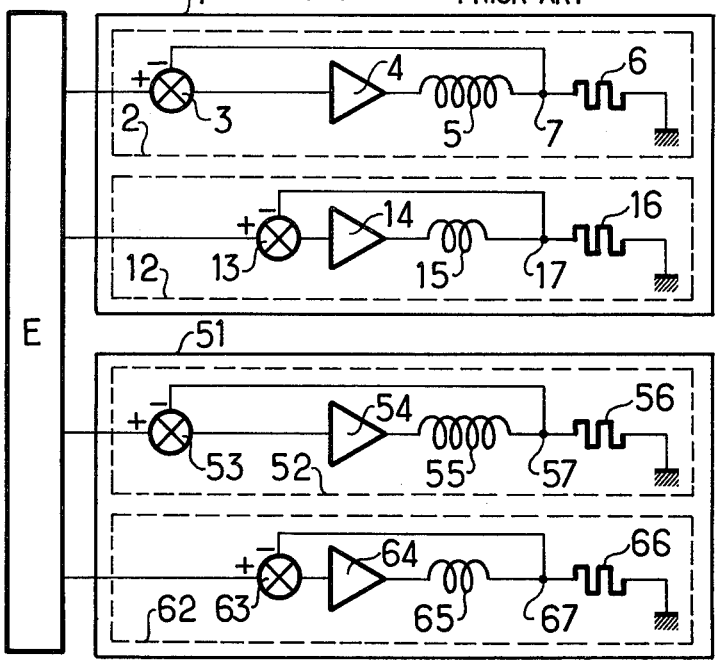
FIG. 1 PRIOR ART
FIG. 1 shows a deflection system of a known type.

The deflection system of a known type such as shown in FIG. 1 comprises a horizontal deflection device 1 and a vertical deflection device 51.

The deflection system is fed by a deflection signal generator E.

The horizontal deflection device 1 comprises a slow response deflection circuit 2 and a rapid response deflection circuit 12.

The slow response deflection circuit 2 comprises a subtractor 3 having a + input on which is applied a deflection signal, a direct current amplifier 4 having a limited band whose output is connected to a deflection coil 5.

The deflection coil 5 is connected to a resistor 6 connected to ground. The point 7 common to that coil and to the grounded resistor is connected to the − input of the subtractor 3.

The deflection coil 5 comprises a great number of turns.

The rapid response deflection circuit 12, comprises, in a like manner, a subtractor 13 having a + input on which is applied a deflection signal coming from the generator E, a − input and a wide band direct current amplifier 14 feeding a deflection coil 15.

The deflection coil 15 is connected to a grounded resistor 16; the common point 17 between the coil 15 and the resistor 16 is connected to the − input of the subtractor 13.

The deflection coil 15 comprises a small number of turns.

The vertical deflection device 51 consists of the same elements as the horizontal deflection device 1.

The vertical deflection device 51 comprises a slow response deflection circuit 52 and a rapid response deflection circuit 62, the slow response deflection circuit comprising a subtractor 53, a direct current amplifier 54 having a limited band, a deflection coil 55, a grounded resistor 56, the common point 57 between the coil 55 and the resistor 56 being connected to the − input of the subtractor 53. The rapid response deflection circuit comprises a subtractor 63, a wide band direct current amplifier 64, a deflection coil 65, a grounded resistor 66. The common point 67 between the coil 65 and the resistor 66 is applied to the − input of the subtractor 63.

The coil 55 comprises a great number of turns and the coil 65 comprises a small number of turns.

Figure 2:
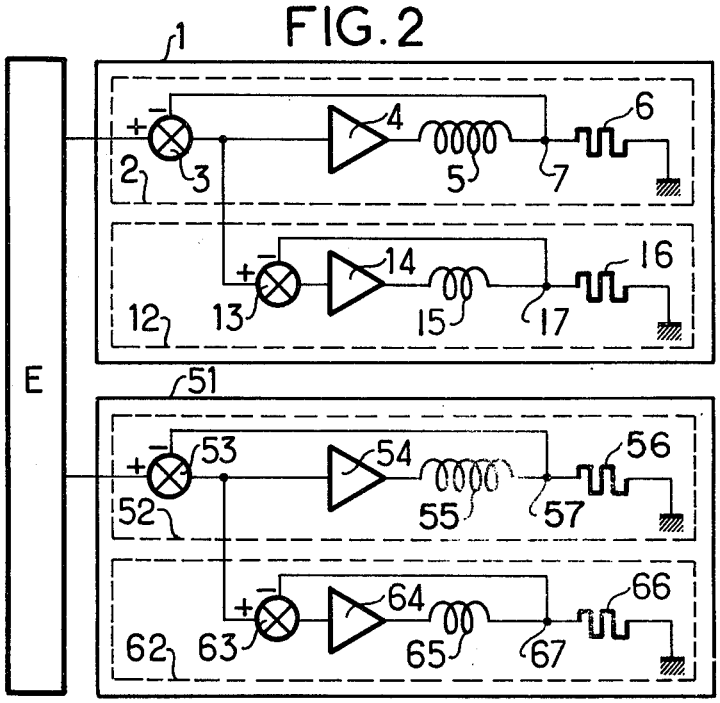
FIG. 2 shows a first embodiment of a deflection system according to the invention.

The deflection system according to the invention such as shown in FIG. 2 comprises the same elements as the deflection system known in the art shown in FIG. 1 and they will not be described again here. In the According to another embodiment of the deflection system according to the invention shown in FIG. 3, the slow response deflection circuits are identical to those shown in FIG. 2, but the rapid response deflection circuits are modified.

The rapid response circuit 12 of the horizontal deflection device 1 comprises a subtractor 13 whose output is connected to the input of a direct current amplifier 14′ having two symmetrical outputs connected together at the terminals of the plates 15′ and at the two inputs of an auxiliary subtractor 16′ whose output is connected to the − input of the subtractor 13. The + input of the subtractor 13 is connected as in the preceding embodiment to the output of the subtractor 3.

The rapid response circuit 62 of the vertical deflection device 51 comprises exactly the same elements as the rapid response circuit 12 of the horizontal deflection device. The circuit 62 therefore comprises a subtractor 63, a direct current amplifier 64′ having two symmetrical outputs connected to plates 65′ and to the two inputs of an auxiliary subtractor 66′ whose output is connected to the − input of the subtractor 63, the + input of the subtractor 63 being connected to the output of the subtractor 53 of the slow response deflection circuit.

FIGS. 4*a*, 4*b*, 4*c*, 4*d* show 4 curves indicating the variations of certain signals as a function of time in the deflection system of a known type.

Figure 4A:
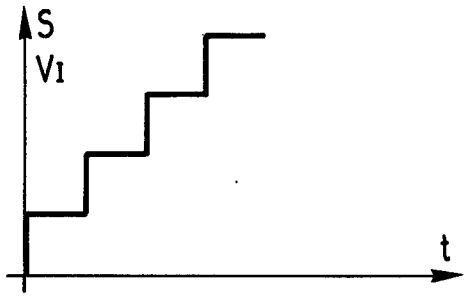
FIG. 4a PRIOR ART

FIG. 4*a* shows a signal S increasing like the steps of a staircase, equal to the sum of the magnetic fields which the horizontal deflection coils as well as those of the vertical deflection coils are required to produce to obtain a certain sequence of points on the screen of the tube.

The signal S for only one of the deflection devices will be examined here, the reasoning being identical for the other device.

According to the known art, the voltage $V_i$ having the same form as S, which is generally available, is separated into voltages $V_j$ and $V_k$, the voltage $V_j$ being a voltage having high great amplitude varying slowly and $V_k$ being a voltage having slight amplitude varying rapidly.

Figure 4B:
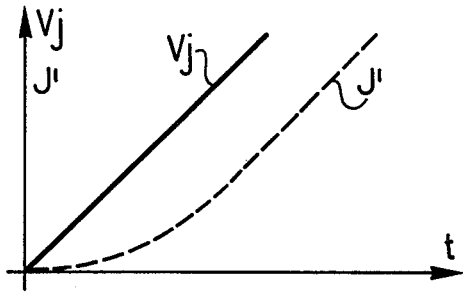
FIG. 4b PRIOR ART

FIG. 4*b* shows the voltage $V_j$ in a continuous line in the case where S has the form shown in FIG. 4*a*. The voltage $V_j$ is applied to the + input of the subtractor 3. The magnetic field J′ produced effectively by the coil is shown by a discontinuous line. The amplifier charged by the coil having a very limited band width J′ has a delay in relation to $V_j$.

Figure 4C:
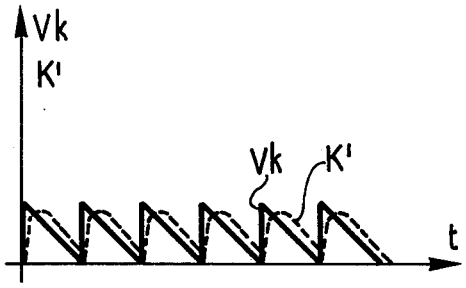
FIG. 4c PRIOR ART

FIG. 4*c* shows the voltage $V_k$ which is equal to $V_i - V_j$ and therefore has the form of a saw tooth in the case considered. That voltage $V_k$ is applied to the + input of the subtractor 13. $V_k$ is shown by a continuous line.

The magnetic field produced by the coil 15 has been shown at K'. The amplifier having a wide bank K' is not very different from $V_k$.

Figure 4D:
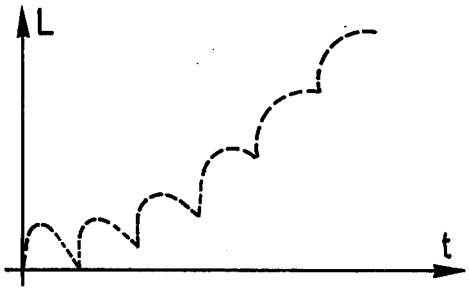
FIG. 4d PRIOR ART

FIG. 4*d* shows the sum L of the magnetic fields J' and K' as a function of time. It will easily be observed that this is far from the curve like the steps of a staircase required and shown in FIG. 4*a*.

The deviation of the spot along an axis as a function of time is shown by the curve L.

As a similar deviation of the spot would be obtained along the perpendicular axis, it would therefore not be possible to obtain the sequence of points required which can be obtained only when the sum of the currents passing through the horizontal deflection coils and the sum of the currents passing through the vertical deflection coils are in the form of the steps of a staircase.

FIGS. 5*a*, 5*b*, 5*c*, 5*d* show signal curves as a function of the time which illustrate the operation of the deflection system according to the invention.

Figure 5A:
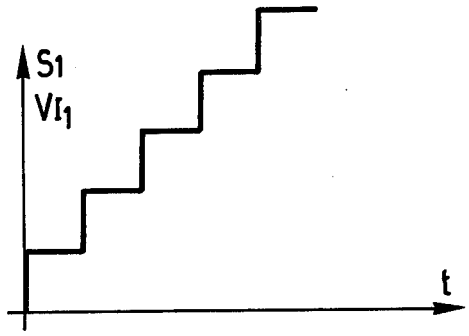

FIG. 5*a* shows the signal $S_1$ which is equal to the sum of the magnetic fields which the horizontal deflection coils as well as the vertical deflection coils are required to produce to obtain a certain sequence of points on the screen of the tube.

Only one of the deflection devices will be examined here, the reasoning to be made being identical for the other.

The voltage $V_{i1}$ having the same form as $S_1$ is applied to the + input of the subtractor 3 of the deflection device 2 shown in FIG. 2.

Figure 5B:
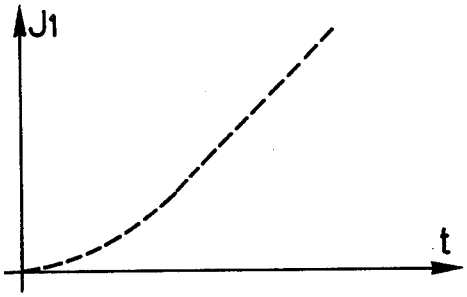

FIG. 5*b* shows the magnetic field $J_1$ produced by the coil 5. The charged amplifier having a limited band $J_1$ has a delay in relation to the $V_{i1}$ and does not reproduce its sudden variations.

Figure 5C:
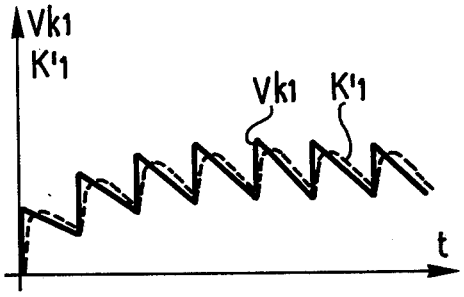

FIG. 5*c* shows by a continuous thick line the voltage $V_{k1}$ which is obtained at the output of the subtractor 3. The voltage $V_{k1}$ is equal to the difference between $V_{i1}$ and $V_{j1}$, $V_{j1}$ being the image of the field produced by the coil 5.

The voltage $V_{k1}$, is applied to the input of the subtractor 13 and the coil 15 produces a magnetic field $K'_1$ which does not differ greatly from $V_{k1}$ inasmuch it concerns the form. $K'_1$ is shown by a discontinuous line.

Figure 5D:
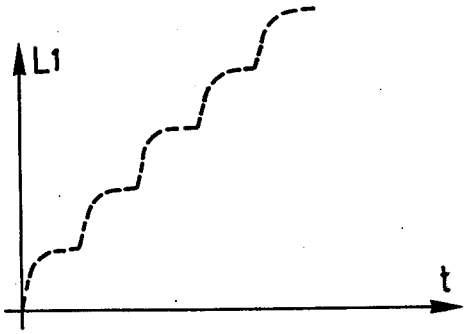

FIG. 5*d* shows the sum $L_1$ of the magnetic fields $J_1$ and $K'_1$ produced by the deflection coils 5 and 15. The form of $L_1$ is very similar to that of the signal $S_1$ in the form of the steps of a staircase, this meaning that with the deflection system according to the invention, it is possible, starting with signals in the form of the steps of a staircase, to obtain a deviation, along each axis, as a function of time, which is in the form of the steps of a staircase.

Figure 3:
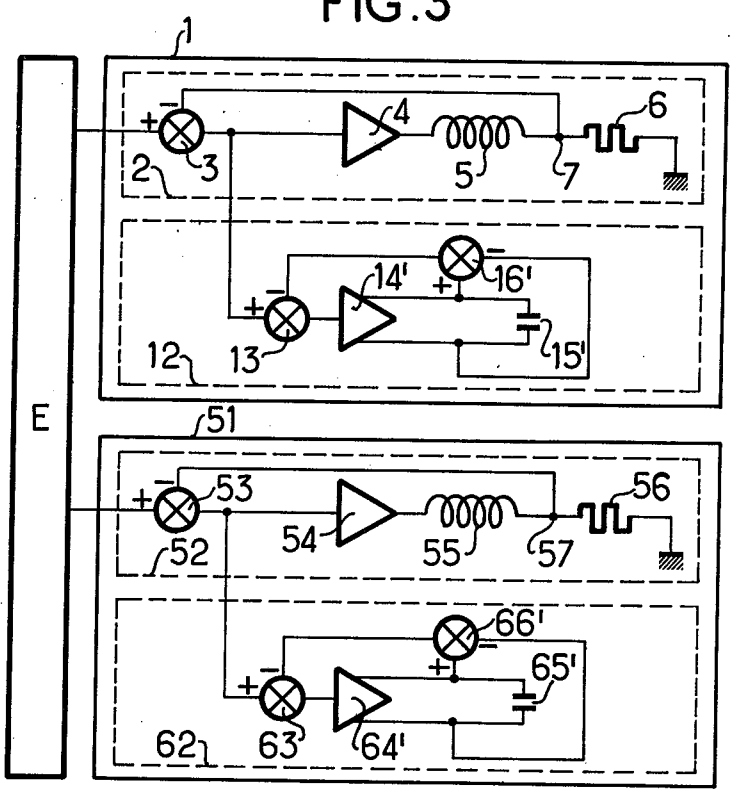
FIG. 3 shows a second embodiment of a deflection system according to the invention.

The operation of the deflection system according to FIG. 3 is identical to the operation of the deflection system according to FIG. 2 which has just been explained.

FIG. 6 shows an improvement of the deflection system according to the invention.

To the deflection system according to FIG. 2 have been added two threshold devices 30 and 80 which send out a signal when they are fed by a signal having a lower value than a reference signal So which corresponds to the signal saturating the rapid response deflection circuits. The threshold device 30 is fed by the output signal of the subtractor 3 and the threshold device 80 is fed by the subtractor 53.

The output of these two threshold devices is applied to an AND gate 40 whose output controls the deflection signal generator E feeding the deflection devices.

Due to that improvement, the marking of points is effected with a great saving of time. Indeed, previously, when two curves represented by points were to be marked in two different parts of the screen about two average positions, it was necessary to wait until after the marking of the first curve the arrival of the beam in the average position of the second curve before sending to the deflection system the data relating to the points of the second curve.

The waiting time was chosen equal to the time taken by the spot for covering the distance separating the two end points of the screen.

With the improved system according to the invention, the AND circuit 40 provides a signal as soon as the spot has come to the new average position and the marking of the points may begin again.

Although the deflection system which has just been described may appear to provide the greatest advantages for implementing the invention, it will be understood that various modifications may be made thereto without going beyond the scope of the invention, it being possible to replace certain of these elements by other elements capable of fulfilling the same technical function or an equivalent technical function therein.

What is claimed is:

1. In a deflection system for a cathode ray tube comprising a horizontal deflection device and a vertical deflection device each of these deflection devices comprising a slow response deflection circuit and a rapid response deflection circuit, said slow response deflection circuit comprising, in series, a subtractor having a − input and a + input, a limited band direct current amplifier, a deflection coil and a measuring resistor connected to ground, the point common to the resistor and the coil being connected to the − input of the subtractor and said subtractor receiving on its + input a deflection signal, and said rapid response deflection circuit comprising a subtractor having a + input and a − input and an output connected to the input of a wide band direct current amplifier supplying deflection means and a negative feed back means whose output is connected to the − input of the subtractor, the improvement comprising said + input of said subtractor of the rapid response deflection circuit being connected to the output of said subtractor of the slow response deflection circuit in each of said horizontal and vertical deflection devices.

2. Deflection system for a cathode ray tube according to claim 1, characterized in that the deflection means of the rapid response deflection circuit are constituted by a coil, one of whose ends is connected to the output of the direct current amplifier and whose other end is connected to the negative feed back means, said negative feed back means being constituted by a resistor connected to ground, the common point of said resistor with the deflection coil being connected to the − input of the subtractor of said rapid response deflection circuit.

3. Deflection system for a cathode ray tube according to claim 1, characterized in that said wide band direct current amplifier of the rapid response deflection circuit comprises two symmetrical outputs connected to the deflection means of said rapid response deflection circuit, said deflection means of said circuit being constituted by plates and wherein said negative feed back means of said circuit are constituted by an auxiliary subtractor whose inputs are connected to said two symmetrical outputs of the direct current amplifier and whose output is connected to the − input of said subtractor feeding the direct current amplifier of said rapid response deflection circuit.

4. Deflection system for a cathode ray tube according to claim 1, comprising two theshold devices each connected to the output of the subtractor of each slow response deflection circuit of said horizontal and vertical deflection devices, each of said two threshold devices providing a signal upon receiving signals having a lower value than a predetermined saturation signal So for the rapid response circuits; and an AND circuit fed by said two threshold devices, said AND circuit providing an output signal for controlling the application of signals to said horizontal and vertical deflection devices.

5. Deflection system for a cathode ray tube according to claim 2, comprising two threshold devices, each connected to the output of the subtractor of each slow response deflection circuit of said horizontal and vertical deflection devices, each of said two threshold devices providing a signal upon receiving signals having a lower value than a predetermined saturation signal So for the rapid response circuits; and an AND circuit fed by two threshold devices, said AND circuit providing an output signal for controlling the application of signals to said horizontal and vertical deflection devices.

6. A deflection system for a cathode ray tube comprising a horizontal deflection device and a vertical deflection device, each of said horizontal and vertical deflection devices including a slow response deflection circuit and a rapid response deflection circuit, means for applying a deflection signal to said slow response deflection circuit of each of said horizontal and vertical deflection devices, and means for applying a control signal generated by said slow response defelection circuit to said rapid response deflection circuit of each of said horizontal and vertical deflection devices, said control signal being a measure of signal delay in said slow response deflection circuit.

7. A deflection device according to claim 6, wherein said means for applying a deflection signal only applies said deflection signal to said slow response deflection circuit.

* * * * *